US008931624B2

(12) United States Patent
Lindner et al.

(10) Patent No.: US 8,931,624 B2
(45) Date of Patent: Jan. 13, 2015

(54) TRANSPORT SYSTEM FOR ACCOMMODATING AND TRANSPORTING FLEXIBLE SUBSTRATES

(75) Inventors: Friedrich Paul Lindner, Schärding (AT); Thomas Glinsner, St. Florian (AT); Gerald Kreindl, Schärding (AT)

(73) Assignee: EV Group E. Thallner GmbH, St. Florian (AT)

( * ) Notice: Subject to any disclaimer, the term of this patent is extended or adjusted under 35 U.S.C. 154(b) by 345 days.

(21) Appl. No.: 12/944,867

(22) Filed: Nov. 12, 2010

(65) Prior Publication Data

US 2011/0114450 A1 May 19, 2011

(30) Foreign Application Priority Data

Nov. 18, 2009 (EP) ..... 09014401

(51) Int. Cl.
*B65G 47/00* (2006.01)
*B65H 37/00* (2006.01)

(52) U.S. Cl.
CPC ..... *B65H 37/002* (2013.01)
USPC ..... 198/617

(58) Field of Classification Search
USPC ..... 198/617, 844.1–853
See application file for complete search history.

(56) References Cited

U.S. PATENT DOCUMENTS

| | | | | | |
|---|---|---|---|---|---|
| 2,858,237 | A * | 10/1958 | Walles et al. | ..... | 428/447 |
| 3,608,711 | A * | 9/1971 | Wiesler et al. | ..... | 206/714 |
| 3,745,846 | A * | 7/1973 | Birckhead et al. | ..... | 198/847 |
| 3,867,027 | A * | 2/1975 | Weigl | ..... | 399/164 |
| 4,770,290 | A * | 9/1988 | Eroskey et al. | ..... | 198/847 |
| 4,922,304 | A * | 5/1990 | Gilbert et al. | ..... | 399/322 |
| 5,865,298 | A * | 2/1999 | Furlani et al. | ..... | 198/805 |
| 5,943,951 | A * | 8/1999 | Muellner et al. | ..... | 100/37 |
| 6,451,154 | B1 * | 9/2002 | Grabau et al. | ..... | 156/300 |
| 6,889,427 | B2 * | 5/2005 | Yee et al. | ..... | 29/832 |
| 6,994,210 | B2 * | 2/2006 | Kerwel et al. | ..... | 198/847 |
| 7,176,799 | B1 * | 2/2007 | Golicz et al. | ..... | 340/572.1 |
| 7,948,384 | B1 * | 5/2011 | Kennedy | ..... | 340/572.8 |
| 2001/0003324 | A1 * | 6/2001 | Blankenhorn | ..... | 198/844.1 |
| 2006/0194412 | A1 | 8/2006 | Nakayama | ..... | 438/455 |
| 2008/0256771 | A1 * | 10/2008 | Spoors et al. | ..... | 29/428 |

FOREIGN PATENT DOCUMENTS

| | | | | |
|---|---|---|---|---|
| EP | 0894746 | 2/1999 | | |
| EP | 1698999 | 9/2006 | ..... | G06K 17/00 |
| WO | WO 2008/120248 | 10/2008 | ..... | H01L 21/00 |

* cited by examiner

*Primary Examiner* — William R Harp
(74) *Attorney, Agent, or Firm* — Kusner & Jaffe

(57) ABSTRACT

This invention relates to a transport foil/film as well as a transport system for holding and transport of at least one thin flexible substrate and a corresponding method and a use of a flexible transport foil/film for holding and for transport of at least one thin, flexible substrate, the substrates being able to be fixed or being fixed at least temporarily on the transport foil/film and the transport foil/film being drivable by driving means for transport of the substrates.

12 Claims, 4 Drawing Sheets

TRANSPORT SYSTEM FOR ACCOMMODATING AND TRANSPORTING FLEXIBLE SUBSTRATES

FIELD OF THE INVENTION

The invention relates to a transport foil/film and a transport system for accommodating and transporting at least one thin flexible substrate and a corresponding method and the use of a flexible transport foil/film for accommodating and for transporting at least one thin, flexible substrate.

BACKGROUND OF THE INVENTION

In the processing of thin substrates with a thickness of less than 1 mm, for example of wafers or in the production of silicon-based photovoltaic cells, the substrates which generally have a diameter of at least 20 cm (for example in wafer processing) and/or at least 10 cm diameter for noncircular, flat substrates (for example in Si-based photovoltaic cell production), are conventionally transported with vacuum grippers by robots between individual process modules. During gripping, also due to the applied vacuum, damage or breaking of the substrates repeatedly occurs, for very thin substrates even warpage on the suction holes of the vacuum grippers.

Existing approaches support the thin substrates by applying the thin substrates to carrier substrates (temporary bonding), therefore by temporary fixing on the carrier so that the thin substrates can be safely transported and processed in substrate processing systems. This method is currently not being used in the photovoltaics industry since it is too expensive compared to the market prices for these modules. Still, it is desirable to be able to use thin substrates since they enable higher efficiency in the conversion of light into electrical energy. In particular, semiconductor base material can also be saved if more preferably a corresponding production method for thin substrates is used in substrate production.

The major barriers to commercial use are moreover transport logistics or the type of transport as well as the technology in the production environment and the lack of suitable methods and means for transporting these thin substrates for example from the substrate manufacturer to photovoltaic production.

SUMMARY OF THE INVENTION

Therefore the object of this invention is to provide an alternative transport system or method with which thin substrates can be safely transported with a high throughput at minimum possible costs.

The framework of the invention encompasses all combinations of at least two of the features given in the specification, the claims, and/or the figures. In the specified value ranges, values which lie within the indicated limits will also be disclosed as boundary values and they are to be claimed in any combination.

The invention is based on the idea of accommodating the substrates on a transport foil/film and transporting them between the individual process modules. In contrast to the existing procedure in microchip production for supporting and stabilizing the thin substrates by carrier substrates, this invention takes the opposite approach by its providing the carrier, in this case a transport foil/film, as a flexible component. This transport foil/film which made as a transport belt has the additional advantage that the substrates can be transported prefabricated on the transport foil/film, especially wound onto a transport roll, preferably from the manufacturer of the transport foil/film or manufacturer of the substrates with prefabricated substrates to the processor. As claimed in the invention a system is thus devised which makes it possible to fasten thin and thus flexible substrates on a flexible carrier system and to make this entire system windable for handling, storage and transport.

The transport foil/film is provided with the advantage of an especially soft, preferably scratch-free material which is protective of the substrates, especially at least on the back of the transport foil/film, in order to protect the front of the substrate in the wound state or to prevent damage such as scratches or the like. The transport foil/film has a somewhat greater width than the substrates, especially between 20 and 50 cm. But it can also be imagined that there are several substrates next to one another on the transport foil/film. It is moreover advantageously possible to accommodate the substrates on both sides of the transport foil/film.

The flexible transport foil/film in one advantageous embodiment is designed as an especially endless belt so that continuous processing of the substrates is enabled.

In another advantageous embodiment it is provided that the transport foil/film is formed from plastic and/or fiber material, especially glass-fiber reinforced. On the one hand, this ensures the stability of the carrier system, especially stability relative to geometrical distortions, and on the other hand careful accommodation of the substrates.

Advantageously the transport foil/film is or can be wound especially onto a transport roll so that transport from the manufacturer to the processor is possible in a space-saving manner.

According to another advantageous embodiment of the invention the transport foil/film has a thickness <1000 μm, especially <500 μm, preferably <200 μm.

To the extent the substrates are temporarily fixed by an especially flexible cement, especially wound prefabricated onto a transport roll, safe and careful transport of the substrates on the transport foil/film is enabled. The cement can be advantageously easily dissolved, especially by UV irradiation, thermally, by solvents, stripping, or unwinding. Preferably dissolution takes place by reducing the contact surface in adhesion cementing methods.

According to one advantageous embodiment of the invention, it is provided that the substrates are formed at least predominantly from at least one material of the group of semiconductors or connecting semiconductors, especially from glass, silicon, gallium arsenide (GaAs), indium phosphide (InP), ceramic, the substrates having a thickness <200 μm, especially <100 μm, preferably <50 μm.

The material for the transport foil/film as claimed in the invention in one especially advantageous version is at least in part, especially predominantly, special steel, preferably in the form of a hybrid foil/film, preferably formed by a metal core with a plastic coating.

In particular the foil/film is made such that electrostatic charging is prevented or can be dissipated in an orderly manner. This is achieved by the foil/film having a conductivity of >10e-15 S/m, more preferably >10e-12 S/m, even more ideally >10e-9 S/m. The conductive foil/film in interplay with suitable devices in the production facilities and transport systems enables orderly dissipation of the charges. Conductive plastic is achieved here by doping of the plastic with conductive additives. The material for the transport foil/film could also be woven plastic such as for example GoreTex® and woven plastic with a suitable coating or any woven fiber with suitable coating.

Other advantages, features and details of the invention will become apparent from the following description of preferred exemplary embodiments and using the drawings.

DETAILED DESCRIPTION OF PREFERRED EMBODIMENTS

In the figures the same components and components with the same function are identified with the same reference number.

Figure 1:
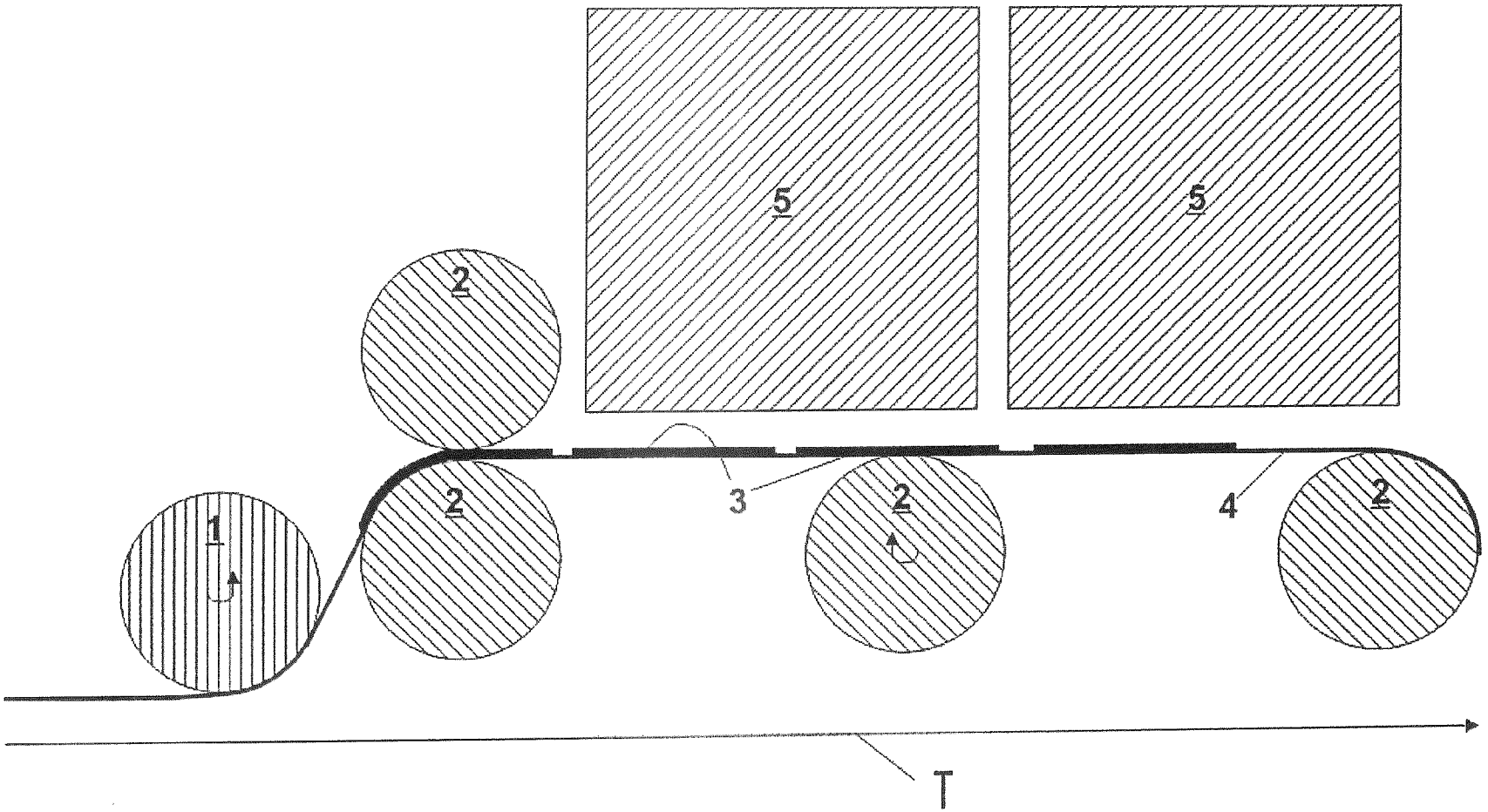
FIG. 1 shows a schematic side view of a transport system as claimed in the invention.

FIG. 1 shows a transport foil/film 4 in the form of a transport belt which is driven by at least one driving roll 1 in one direction of rotation by frictional contact with the transport foil/film 4. In this way, flexible substrates 3 which are fixed, especially cemented, on the transport foil/film can be transported along a transport distance T. The transport distance T can be a closed distance in which the start corresponds to the end so that the transport belt or the transport foil/film 4 is made endless.

Along the transport distance, in FIG. 1 two process modules 5 are schematically shown in which defined process steps are carried out on the substrates 3, for example lithography, exposure, development, sputtering, heating, cooling, deposition, etching, implanting, embossing, bonding, etc. The substrates are moved into position via suitable deflection/guide rolls 2 and by moving the transport foil/film 4 by means of the driving roll 1. The transport belt or the transport foil/film 4 can also be a moved through closed process module spaces, especially with underpressure or overpressure by the transport belt or the transport foil/film 4 being moved by way of a fluidic seal into the corresponding process module space 5 on one side and out on the other side.

Figure 2:
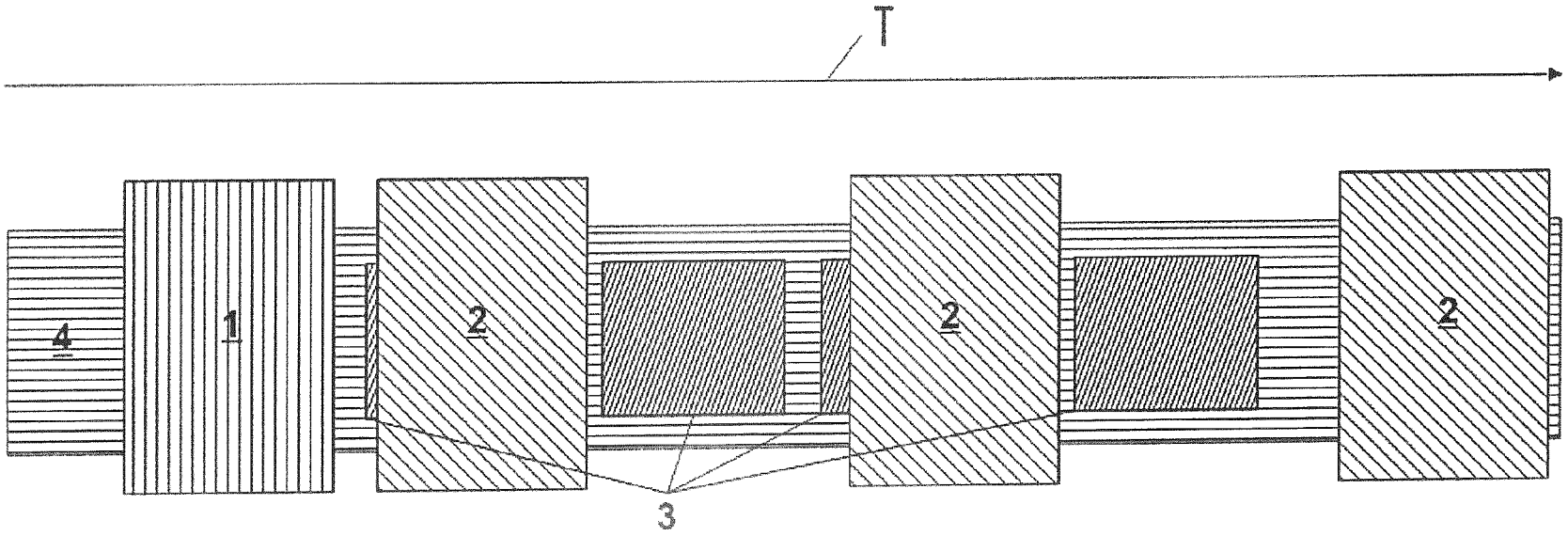
FIG. 2 shows a schematic top view of the transport system as claimed in the invention.

FIG. 2 shows the transport foil/film 4 with the substrates 3 fixed on it in a plane view, in this case square substrates 3 being shown, but also round substrates, for example wafers, can be processed. The diameter or the transverse extension of the substrates is advantageously smaller than the width of the transport belt 4 and advantageously the substrates 3 are fixed with a distance along the transport distance T on the transport foil/film 4 so that detection of the position of the individual substrates 3 is enabled and the substrates 3 can be moved accordingly precisely to the processing position in the process modules. Advantageously position marks for positioning of the substrates can be applied to the foil/film. They are raised off the material of the transport foil/film in terms of contrast. Alternatively index holes can be machined into the transport foil/film. They can be used in one preferred embodiment in interplay with specially made rolls for improved driving in which there is positive contact between the driving roll and foil/film.

Figure 3:
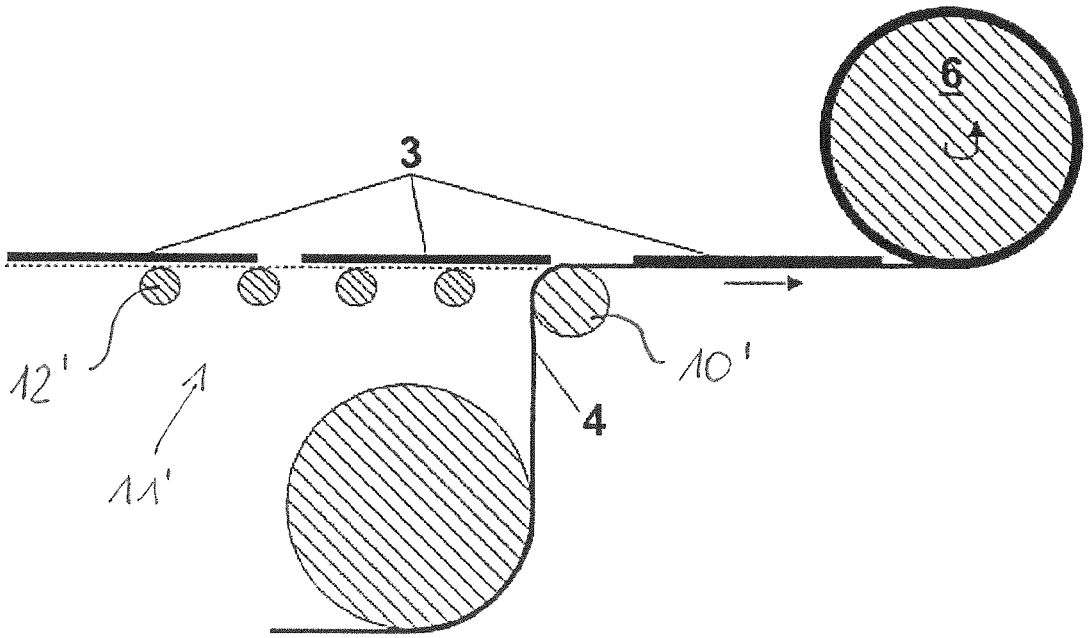
FIG. 3 shows a schematic side view of the transport system as claimed in the invention during winding.

The transport foil/film 4 can be delivered wound on a transport roll 6 which is shown in FIG. 3, advantageously the substrates 3 being delivered prefabricated already wound on the transport roll 6. Alternatively the substrates 3 can be applied to the transport foil/film at the start of the transport distance T. On the end of the transport distance the processed substrates 3 are detached for further processing of the transport foil/film 4, for example when using a UV-soluble cement as the connecting means between the transport foil/film 4 and the substrates 3 by UV light irradiation at the end of the transport distance T.

Figure 4:
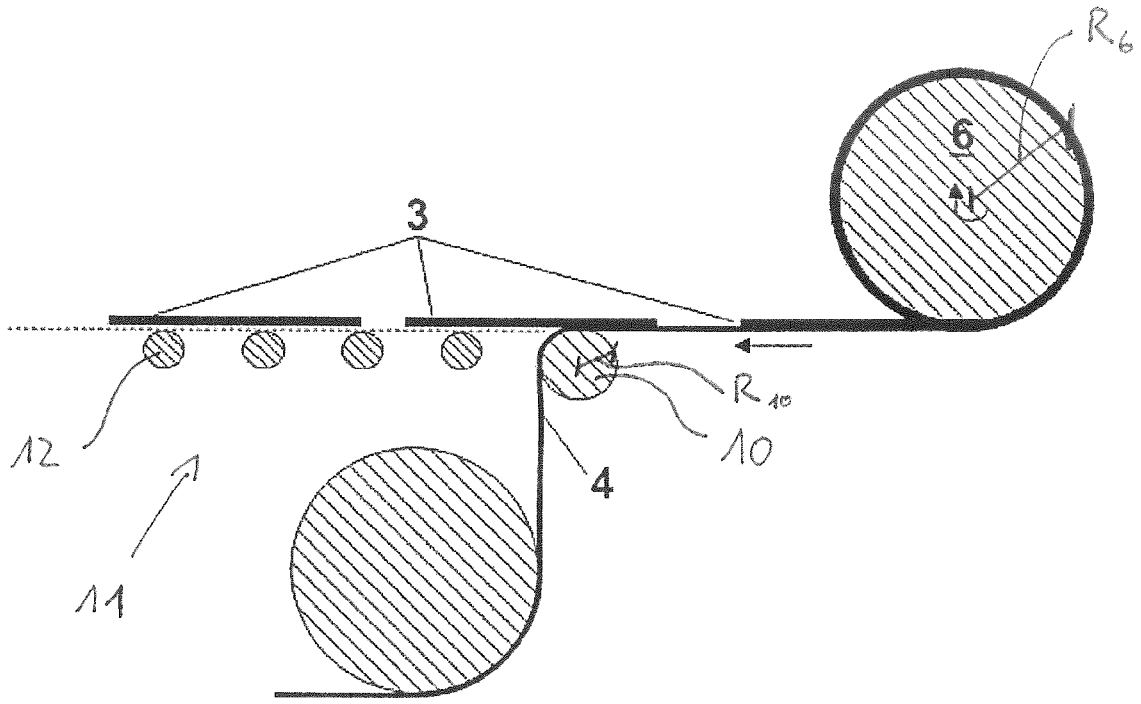
FIG. 4 shows a schematic side view of a transport system as claimed in the invention during unloading.

Detachment or unloading of the processed substrates 3 is shown in FIG. 4 in one sample embodiment. In this embodiment the transport foil/film 4 is deflected by a deflection roll 10 in the direction of the side of the transport foil/film 4 facing away from the substrates 3, and especially with a deflection angle of at least 45°, preferably at least 90°. Preferably the deflection roll 10 has a radius $R_{10}$, smaller than the radius $R_6$ of the transport roll 6, especially with a ratio of <1/2, preferably <1/4. In this way the detachment of the substrates 3 from the transport foil/film 4 is supported. The flexible substrates are advantageously transferred to a linear transport means 11 with transport rolls 12.

The application of the flexible substrates 3 to the transport foil/film 4 takes place more or less in the reverse direction, as is shown in FIG. 3, a deflection roll 10', especially identical to the deflection roll 10, being arranged such that the transport foil/film runs in an extension of a linear transport means 11' and holds the flexible substrates 3 for further transport to a transport roll 6. The linear transport means 11' is driven by transport rolls 12'.

Figure 5:
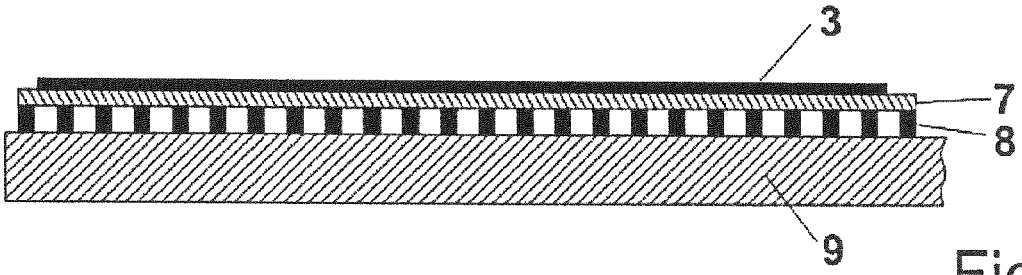
FIG. 5 shows a schematic sectional view of a transport foil/film as claimed in the invention.

According to one embodiment, the transport foil/film 4 can be advantageously structured as shown in FIG. 5. The foil/film in this embodiment consists of a base foil/film 9, preferably of plastic, on which a network 8 is applied which consists especially of plastic and/or fabric fibers. On the network 8 a foil/film 7 which is made preferably as a flexible plastic film is fixed which for its part fixes the flexible substrates 3, especially by adhesion forces.

Figure 6:
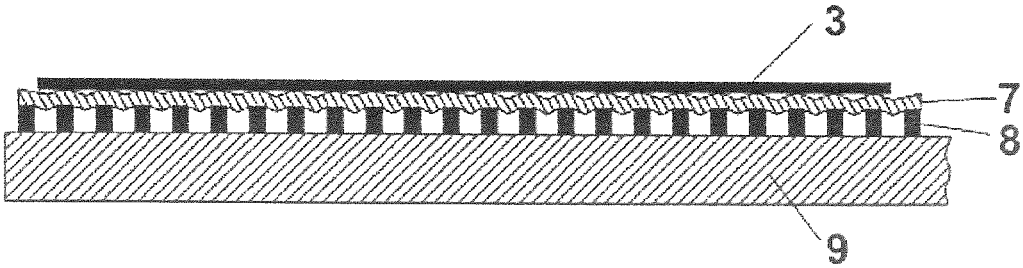
FIG. 6 shows a sectional view of the transport foil/film as claimed in the invention during unloading.

FIG. 6 shows the state of the transport foil/film 4 directly before unloading as shown in FIG. 4. Here, in the region of the network 8, a negative pressure, especially a vacuum, is applied so that the flexible plastic film 7 is at least partially cambered in the direction of the base foil/film 9. In this way the contact surface between the flexible substrates 3 and the foil/film 7, especially at a host of contact sites, is made smaller, by which easier separation of the flexible substrates 3 from the transport foil/film 4 is enabled.

Having described the invention, the following is claimed:

1. A feed roller having a flexible transport foil/film, in combination with, at least one thin, large-area flexible substrate wound onto the feed roller, the flexible transport foil/film for accommodating and for transporting the at least one thin, flexible substrate attached to the transport foil/film, the at least one thin substrate having a thickness of less than 100 μm and a diameter of at least 10 cm, being prefabricated and formed of at least one material selected from a semiconductor and a compound semiconductor, an adhesive disposed on the transport foil/film for fixing the at least one flexible substrate at least temporarily on the transport foil/film and the transport foil/film being attachable to at least one drive roller for transporting the at least one substrate along a transport path.

2. The feed roller as claimed in claim 1, wherein the transport foil/film is formed from plastic and/or fiber material.

3. The feed roller as claimed in claim 1, wherein the transport foil/film has a thickness <1000 μm.

4. The feed roller as claimed in claim 1, wherein the at least one substrate is formed from one of the materials cited below: glass, Si, GaAs, InP, ceramic.

5. The feed roller as claimed in claim 1, wherein the at least one substrate has a thickness <50 μm.

6. The feed roller as claimed in claim 1, wherein the transport foil/film is formed at least in part from steel.

7. The feed roller as claimed in claim 1, wherein the transport foil/film is formed of hybrid foil/film consisting of a metal core with a plastic coating.

8. The feed roller as claimed in claim 1, wherein a back of the flexible transport foil/film is made of a scratch-free material.

9. The feed roller as claimed in claim 1, wherein the flexible transport foil/film has a width of between 20 and 50 cm.

10. The feed roller as claimed in claim 1, wherein at least one thin, large-area flexible substrate is disposed on each side of the flexible transport foil/film.

11. Transport system for accommodating and for transporting at least one thin, large-area flexible substrate having a thickness of less than 100 μm and a diameter of at least 10 cm along a transport path of the transport system, the transport system having a feed roller having a flexible transport foil/film, in combination with, at least one thin flexible substrate wound onto the feed roller, the flexible transport foil/film for at least temporary fixing of the at least one thin, flexible substrate thereto and at least one drive roller for driving of the transport foil/film along the transport path.

12. Method for accommodating and for transport of at least one thin, flexible substrate along a transport path of the transport system, as claimed in claim 10, with the following steps;

transporting of the at least one thin, flexible substrate by driving the transport foil/film to at least one process module using the at least one drive roller.

* * * * *